US008851854B2

(12) United States Patent
Alexander

(10) Patent No.: US 8,851,854 B2
(45) Date of Patent: Oct. 7, 2014

(54) ENERGY ABSORBENT FAN BLADE SPACER

(75) Inventor: Phillip Alexander, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 474 days.

(21) Appl. No.: 13/328,668

(22) Filed: Dec. 16, 2011

(65) Prior Publication Data

US 2013/0156591 A1 Jun. 20, 2013

(51) Int. Cl.
*F01D 5/32* (2006.01)

(52) U.S. Cl.
USPC ..... 416/221; 416/500

(58) Field of Classification Search
USPC ..... 416/219 R, 219 A, 220 R, 220 A, 221, 416/248, 500
See application file for complete search history.

(56) References Cited

U.S. PATENT DOCUMENTS

| | | | | |
|---|---|---|---|---|
| 3,216,699 | A * | 11/1965 | Schoenborn | 416/190 |
| 3,572,970 | A | 3/1971 | Smuland | |
| 3,936,234 | A * | 2/1976 | Tucker et al. | 416/220 R |
| 5,123,813 | A | 6/1992 | Przytulski et al. | |
| 5,431,543 | A * | 7/1995 | Brown et al. | 416/221 |
| 5,820,347 | A | 10/1998 | Bussonnet et al. | |
| 6,447,253 | B2 | 9/2002 | Tempere | |
| 6,481,971 | B1 | 11/2002 | Forrester | |
| 7,108,484 | B2 | 9/2006 | Thenaisie et al. | |
| 2005/0254951 | A1 | 11/2005 | Thenaisie et al. | |
| 2009/0004017 | A1 | 1/2009 | Belmonte et al. | |
| 2010/0189564 | A1 | 7/2010 | Stone | |
| 2011/0223027 | A1 | 9/2011 | Klinetob et al. | |
| 2011/0229334 | A1 | 9/2011 | Alexander | |
| 2012/0107125 | A1 | 5/2012 | Reghezza et al. | |

FOREIGN PATENT DOCUMENTS

DE 19823157 11/1999

OTHER PUBLICATIONS

International search report for PCT/US2012/069785 dated Mar. 25, 2013.

* cited by examiner

*Primary Examiner* — Igor Kershteyn
(74) *Attorney, Agent, or Firm* — O'Shea Getz P.C.

(57) ABSTRACT

A gas turbine engine fan assembly includes a rotor disk, a fan blade and a spacer. The rotor disk includes a longitudinally extending slot with a first spacer contact surface. The fan blade includes a root with a second spacer contact surface arranged within the slot. The spacer includes a leaf spring backbone and a compliant member. The leaf spring backbone includes one or more root contact segments connected longitudinally to one or more slot contact segments. A first of the root contact segments contacts the second spacer contact surface, and a first of the slot contact segments contacts the first spacer contact surface. The compliant member is radially between the first spacer contact surface and the first root contact segment, and radially between the second spacer contact surface and the first slot contact segment.

20 Claims, 3 Drawing Sheets

ENERGY ABSORBENT FAN BLADE SPACER

BACKGROUND OF THE INVENTION

1. Technical Field

The present invention relates generally to gas turbine engines and, in particular, to a fan assembly that includes one or more energy absorbent fan blade spacers.

2. Background Information

A fan assembly for a typical gas turbine engine includes a plurality of fan blades arranged circumferentially around a rotor disk. Each fan blade may include an airfoil connected to a dovetail root, which is inserted into a respective dovetail slot within the rotor disk. The radial height of the root is typically less than the radial height of the slot. A gap therefore may be farmed between a radial inner surface of the root and a radial inner surface of the slot. Such a gap is typically filled with a fan blade spacer.

A typical fan blade spacer reduces slippage and wear between the root and the slot during engine operation when, for example, centrifugal loading on the fan blade is relatively low (e.g., during wind milling). The fan blade spacer may be configured therefore to reduce (e.g., minimize) clearance within the gap that would otherwise be available for relative motion (e.g., pivoting) between the root and the slot. Such a rigid connection between the rotor disk and the fan blade, however, may increase internal strains on the fan blade when, for example, an object (e.g., a bird or a released fan blade) collides with the fan blade.

SUMMARY OF THE DISCLOSURE

According to a first aspect of the invention, a gas turbine engine fan assembly includes a rotor disk, a fan blade and a spacer. The rotor disk includes a longitudinally extending slot with a first spacer contact surface. The fan blade includes a root with a second spacer contact surface arranged within the slot. The spacer includes a leaf spring backbone and a compliant member. The leaf spring backbone includes a root contact segment longitudinally between a first slot contact segment and a second slot contact segment. The root contact segment contacts the second spacer contact surface, and the first and the second slot contact segments contact the first spacer contact surface. The compliant member is radially between the first spacer contact surface and the root contact segment, and radially between the second spacer contact surface and the first and the second slot contact segments.

According to a second aspect of the invention, a gas turbine engine fan assembly includes a rotor disk, a fan blade and a spacer. The rotor disk includes a longitudinally extending slot with a first spacer contact surface. The fan blade includes a root with a second spacer contact surface arranged within the slot. The spacer includes a leaf spring backbone and a compliant member. The leaf spring backbone includes a slot contact segment longitudinally between a first root contact segment and a second root contact segment. The slot contact segment contacts the first spacer contact surface, and the first and the second root contact segments contact the second spacer contact surface. The compliant member is radially between the second spacer contact surface and the slot contact segment, and radially between the first spacer contact surface and the first and the second root contact segments.

The foregoing features and the operation of the invention will become more apparent in light of the following description and the accompanying drawings.

DETAILED DESCRIPTION OF THE INVENTION

Figure 1:
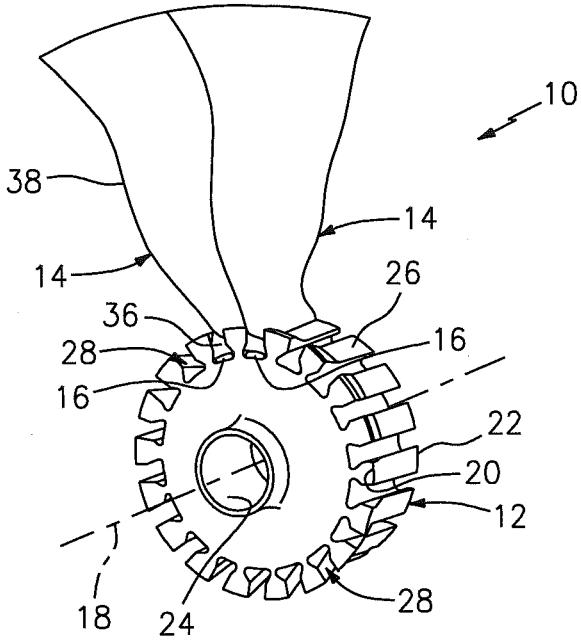
FIG. 1 is a perspective illustration of a partially assembled fan assembly for a gas turbine engine.

FIG. 1 illustrates a partially assembled fan assembly 10 for a gas turbine engine (e.g., a turbofan engine). The fan assembly 10 includes a rotor disk 12, a plurality of fan blades 14 (e.g., composite fan blades), and a plurality of energy absorbent fan blade spacers 16.

Figure 2:
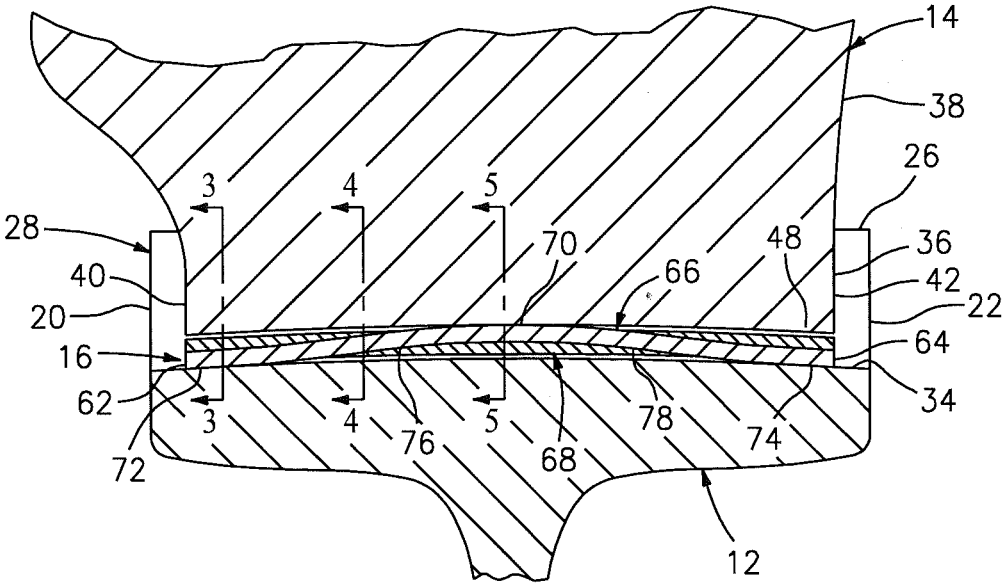
FIG. 2 is a partial, side-sectional illustration of the fan assembly.
Figure 3:
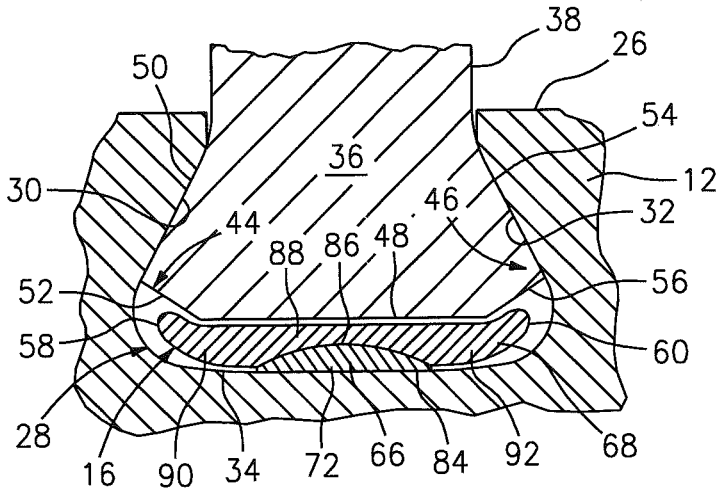
FIG. 3 is a partial, cross-sectional illustration of the fan assembly at the section 3-3 illustrated in FIG. 2.

The rotor disk 12 extends along an axial centerline 18 between a first disk end 20 and a second disk end 22. The rotor disk 12 also extends radially from an inner disk surface 24 to an outer disk surface 26. The rotor disk 12 includes a plurality of slots 28 (e.g., dovetail slots) arranged circumferentially around the axial centerline 18. Referring to FIG. 2, each slot 28 extends longitudinally between the first disk end 20 and the second disk end 22. Referring to FIG. 3, each slot 28 includes a first slot sidewall 30, a second slot sidewall 32 and a first spacer contact surface 34. The first slot sidewall 30 and the second slot sidewall 32 each extend radially inwards from the outer disk surface 26 to the first spacer contact surface 34. The first spacer contact surface 34 extends laterally between the first slot sidewall 30 and the second slot sidewall 32.

Referring again to FIG. 1, each fan blade 14 includes a root 36 and an airfoil 38. Referring to FIG. 2, the root 36 extends longitudinally from a first root end 40 to a second root end 42. Referring to FIG. 3, the root 36 includes a first root sidewall 44, a second root sidewall 46 and a second spacer contact surface 48. The first root sidewall 44 and the second root sidewall 46 each extend radially inwards from the airfoil 38 to the second spacer contact surface 48. The first root sidewall 44 includes a first outer root sidewall segment 50 and a first inner root sidewall segment 52. The second root sidewall 46 includes a second outer root sidewall segment 54 and a second inner root sidewall segment 56. The second spacer contact surface 48 extends laterally between the first and the second inner root sidewall segments 52 and 56.

Figure 4:
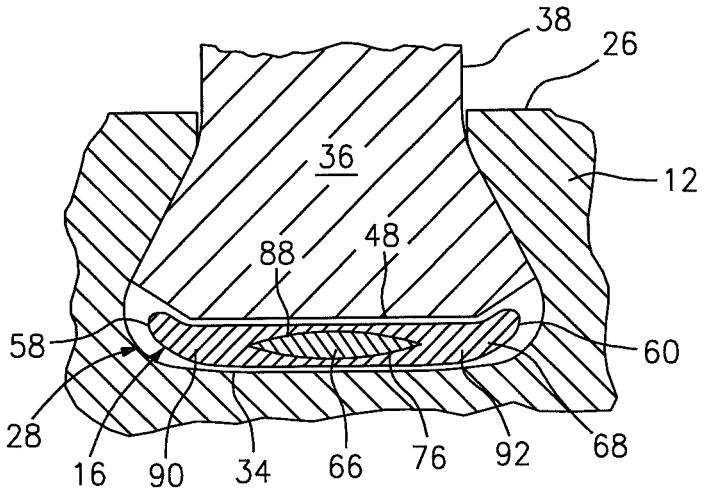
FIG. 4 is another partial, cross-sectional illustration of the fan assembly at the section 4-4 illustrated in FIG. 2.

Referring to FIG. 4, each spacer 16 extends laterally between a first spacer side 58 and a second spacer side 60. Referring to FIG. 2, each spacer 16 also extends longitudinally between a first spacer end 62 and a second spacer end 64. Each spacer 16 may include a leaf spring backbone 66 and a compliant member 68. The leaf spring backbone 66 may be constructed from a rigid elastic material such as, for example, a metallic material (e.g., titanium or aluminum alloy), a carbon composite material (e.g., laminated, 3D woven carbon sheets), etc. The compliant member 68 may be constructed from a compliant material such as, for example, an elastomeric material (e.g., rubber), a viscoelastic composite material (e.g., Kevlar® material and epoxy), etc. Alternatively, the compliant member 68 may be constructed from a plastically crushable material such as, for example, a composite crushable core material, a thermoplastic material (e.g., polyether ether ketone), a thermoset material (e.g., vinyl ester bulk molding compound), a honeycomb structured material, etc.

Referring to FIGS. 2-5, the leaf spring backbone 66 may have a laterally elongated cross-sectional geometry that extends longitudinally between the first spacer end 62 and the second spacer end 64. Referring to FIG. 2, the leaf spring backbone 66 may include a root contact segment 70, a first slot contact segment 72, a second slot contact segment 74, a first intermediate segment 76 and a second intermediate segment 78. The root contact segment 70 is connected longitudinally between the first slot contact segment 72 and the second slot contact segment 74, and extends longitudinally between the first intermediate segment 76 and the second intermediate segment 78. The first slot contact segment 72 extends longitudinally between the first intermediate segment 76 and the first spacer end 62. The second slot contact segment 74 extends longitudinally between the second intermediate segment 78 and the second spacer end 64.

Figure 5:
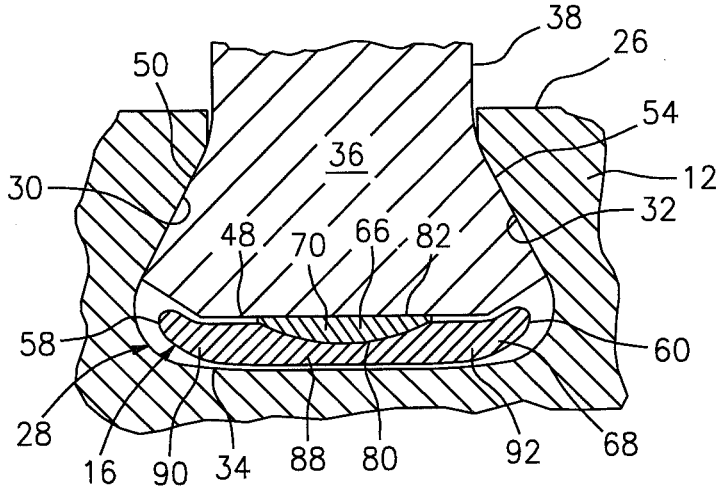
FIG. 5 is another partial, cross-sectional illustration of the fan assembly at the section 5-5 illustrated in FIG. 2.

Referring to FIG. 5, the root contact segment 70 has a root contact segment cross-sectional geometry that extends radially from an inner radial surface 80 to an outer radial surface 82. The inner radial surface 80 may have a curved (e.g., arcuate) cross-sectional geometry. The outer radial surface 82 may have a substantially flat cross-sectional geometry. Referring to FIG. 3, each slot contact segment 72, 74 has a slot contact segment cross-sectional geometry that extends radially from an inner radial surface 84 to an outer radial surface 86. The inner radial surface 84 may have a substantially flat cross-sectional geometry. The outer radial surface 86 may have a curved (e.g., arcuate) cross-sectional geometry. Referring to FIG. 4, each intermediate segment 76, 78 may have a convex-convex lens (or elliptical) cross-sectional geometry that transitions into the root contact segment cross-sectional geometry (see FIG. 5) in one direction, and into the slot contact segment cross-sectional geometry (see FIG. 3) in the opposite direction.

Referring to FIG. 2, the leaf spring backbone 66 extends longitudinally through the compliant member 68. Referring to FIG. 4, the leaf spring backbone 66 may be centered within the compliant member 68 between the first spacer side 58 and the second spacer side 60. In addition, each intermediate segment 76, 78 may be encapsulated within (e.g., surrounded by) the compliant member 68.

Referring to FIGS. 3-5, the compliant member 68 may include a base segment 88 connected between a first side segment 90 and a second side segment 92. The first side segment 90 extends laterally between the leaf spring backbone 66 and the first spacer side 58. The second side segment 92 extends laterally between the leaf spring backbone 66 and the second spacer side 60.

Referring to FIG. 1, the roots 36 and the spacers 16 are respectively arranged within the slots 28. Referring to FIG. 2, the root contact segment 70 engages (e.g., contacts) the second spacer contact surface 48. The first slot contact segment 72 and the second slot contact segment 74 each engage the first spacer contact surface 34. An overall radial, unassembled height of the leaf spring backbone 66 may be greater than a radial gap height between the first spacer contact surface 34 and the second spacer contact surface 48. Referring to FIG. 5, the leaf spring backbone 66 therefore may bias (e.g., preload) the first outer root sidewall segment 50 against the first slot sidewall 30, and the second outer root sidewall segment 54 against the second slot sidewall 32. Referring again to FIG. 2, the compliant member 68 is radially between the first spacer contact surface 34 and the root contact segment 70. The compliant member 68 is also radially between the second spacer contact surface 48 and the first slot contact segment 72 and the second slot contact segment 74.

Figure 6:
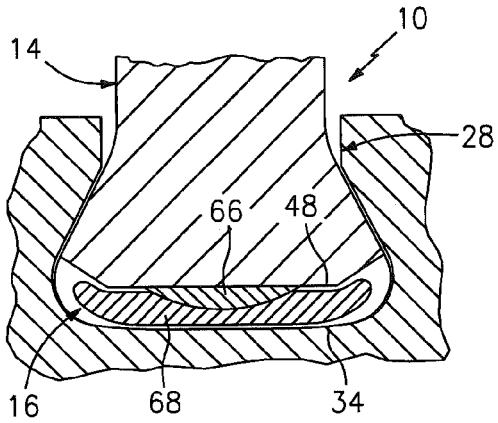
FIG. 6 is a partial, cross-sectional illustration of the fan assembly during a first mode of operation.
Figure 7:
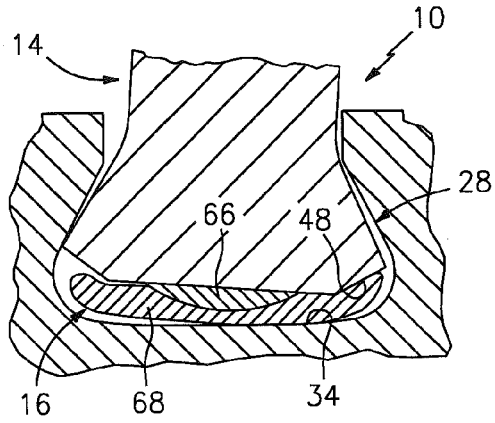
FIG. 7 is a partial, cross-sectional illustration of the fan assembly during a second mode of operation.

FIG. 6 illustrates the fan assembly 10 during a first mode of operation (e.g., during nominal flight conditions). FIG. 7 illustrates the fan assembly 10 during a second mode of operation (e.g., after a foreign object collides with one or more of the fan blades). During the second mode of operation illustrated in FIG. 7, the root 36 may pivot within the slot 28 against the leaf spring backbone 66 and deform (e.g., plastically or viscoelastically) the compliant member 68 between the first spacer contact surface 34 and the second spacer contact surface 48. The deformation may at least partially absorb and, thus, dissipate impact energy exerted onto the fan blade 14 from the collision of the foreign object (e.g., a bird). Thus, the spacer 16 may permit the fan assembly 10 to include lighter weight and/or thinner fan blade 14 designs.

After the collision, the fan blade 14 may return to its original position and the spacer 16 may recover its original shape as illustrated in FIG. 6 where, for example, the compliant member 68 is constructed from the compliant material. Alternatively, the compliant member 68 may remain plastically deformed after the collision as illustrated in FIG. 7 where, for example, the compliant member 68 is constructed from the plastically crushable material.

In some embodiments, the compliant member may extend radially between the first spacer contact surface and the root contact segment. The compliant member may also extend radially between the second spacer contact surface and the first and/or the second slot contact segments.

In some embodiments, the leaf spring backbone may include one or more additional root contact segments and/or one or more additional slot contact segments, where the additional contact segment(s) are configured to provide the leaf spring backbone with an undulating (e.g., wavy) side-sectional geometry.

In some embodiments, the leaf spring backbone may have various alternative changing or substantially uniform cross-sectional geometries. The leaf spring backbone, for example, may have substantially uniform rectangular or circular cross-sectional geometry.

In alternative embodiments, the leaf spring backbone may be asymmetrically arranged towards, or adjacent to, the first spacer side or the second spacer side within the compliant member.

Figure 8:
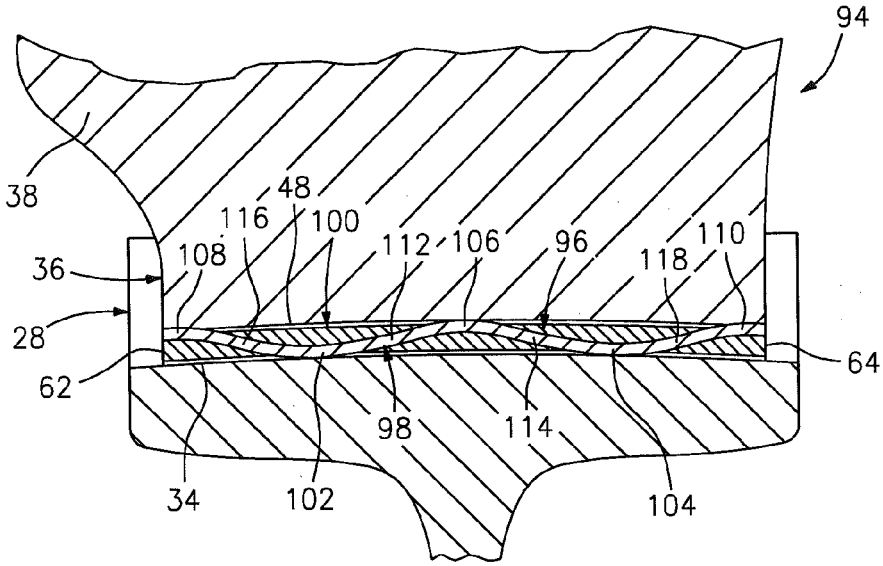
FIG. 8 is a partial, side-sectional illustration of an alternate embodiment fan assembly.

FIG. 8 illustrates another fan assembly 94 for a gas turbine engine. In contrast to the fan assembly 10 illustrated in FIG. 2, the fan assembly 94 includes an alternative embodiment energy absorbent fan blade spacer 96. The spacer 96 includes a leaf spring backbone 98 (e.g., an undulating leaf spring backbone) that extends longitudinally through a compliant member 100.

The leaf spring backbone 98 may include one or more slot contact segments 102 and 104, a plurality of root contact segments 106, 108 and 110, and a plurality of intermediate segment 112, 114, 116 and 118. The first root contact segment 106 is connected longitudinally between the first slot contact segment 102 and the second slot contact segment 104, and extends longitudinally between the first intermediate segment 112 and the second intermediate segment 114. The second root contact segment 108 extends longitudinally from the first spacer end 62 to the third intermediate segment 116, and the third root contact segment 110 extends longitudinally from the second spacer end 64 to the fourth intermediate segment 118. The third intermediate segment 116 is connected longitudinally between the first slot contact segment 102 and the second root contact segment 108, and the fourth intermediate segment 118 is connected longitudinally between the second slot contact segment 104 and the third root contact segment 110.

The first root contact segment 106, the second root contact segment 108 and the third root contact segment 110 each engage the second spacer contact surface 48. The first slot contact segment 102 and the second slot contact segment 104 each engage the first spacer contact surface 34. The compliant member 100 is configured radially between the first spacer contact surface 34 and each of the root contact segments 106, 108 and 110. The compliant member 100 is also configured radially between the second spacer contact surface 48 and each of the slot contact segments 102 and 104.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A gas turbine engine fan assembly, comprising:

a rotor disk comprising a longitudinally extending slot comprising a first spacer contact surface;

a fan blade comprising a root arranged within the slot, the root comprising a second spacer contact surface;

a spacer comprising leaf spring backbone comprising a root contact segment longitudinally between a first slot contact segment and a second slot contact segment, wherein the root contact segment contacts the second spacer contact surface, and the first and the second slot contact segments contact the first spacer contact surface; and a compliant member radially between the first spacer contact surface and the root contact segment, and radially between the second spacer contact surface and the first and the second slot contact segments.

2. The fan assembly of claim 1, wherein the leaf spring backbone preloads sidewalls of the root against respective sidewalls of the slot.

3. The fan assembly of claim 1, wherein the leaf spring backbone comprises a laterally elongated cross-sectional geometry.

4. The fan assembly of claim 3, wherein at least one of the root contact segment, the first slot contact segment and the second slot contact segment extends radially between a first surface with a substantially flat cross-sectional geometry and a second surface with a curved cross-sectional geometry that contacts the compliant member.

5. The fan assembly of claim 1, wherein the leaf spring backbone further comprises a first intermediate segment connected longitudinally between the root contact segment and the first slot contact segment, and a second intermediate segment connected longitudinally between the root contact segment and the second slot contact segment, and wherein at least one of the first and the second intermediate segments are encapsulated within the compliant member.

6. The fan assembly of claim 5, wherein at least one of the first intermediate segment and the second intermediate segment comprises one of a lens and elliptical cross-sectional geometry.

7. The fan assembly of claim 1, wherein the compliant member extends laterally between the leaf spring backbone and a first side of the fan blade spacer, and laterally between the leaf spring backbone and a second side of the fan blade spacer.

8. The fan assembly of claim 1, wherein the leaf spring backbone comprises at least one of a metallic material and a carbon composite material.

9. The fan assembly of claim 1, wherein the compliant member comprises at least one of an elastomeric material, a viscoelastic composite material and a plastically crushable material.

10. The fan assembly of claim 1, wherein the leaf spring backbone further comprises a second root contact segment connected longitudinally between the second slot contact segment and a third slot contact segment, and wherein the compliant member is radially between the first spacer contact surface and the second root contact segment, and radially between the second spacer contact surface and the third slot contact segment.

11. A gas turbine engine fan assembly, comprising:

a rotor disk comprising a longitudinally extending slot comprising a first spacer contact surface;

a fan blade comprising a root arranged within the slot, the root comprising a second spacer contact surface;

a spacer comprising a leaf spring backbone comprising a slot contact segment longitudinally between a first root contact segment and a second root contact segment, wherein the slot contact segment contacts the first spacer contact surface, and the first and the second root contact segments contact the second spacer contact surface; and a compliant member radially between the second spacer contact surface and the slot contact segment, and radially between the first spacer contact surface and the first and the second root contact segments.

12. The fan assembly of claim 11, wherein the leaf spring backbone preloads sidewalls of the root against respective sidewalls of the slot.

13. The fan assembly of claim 11, wherein the leaf spring backbone comprises a laterally elongated cross-sectional geometry.

14. The fan assembly of claim 13, wherein at least one of the root contact segment, the first slot contact segment and the second slot contact segment extends radially between a first surface with a substantially flat cross-sectional geometry and a second surface with a curved cross-sectional geometry that contacts the compliant member.

15. The fan assembly of claim 11, wherein the leaf spring backbone further comprises a first intermediate segment connected longitudinally between the slot contact segment and the first root contact segment, and a second intermediate segment connected longitudinally between the slot contact segment and the second root contact segment, and wherein at least one of the first and the second intermediate segments are encapsulated within the compliant member.

16. The fan assembly of claim 15, wherein at least one of the first intermediate segment and the second intermediate segment comprises one of a lens and elliptical cross-sectional geometry.

17. The fan assembly of claim 11, wherein the compliant member extends laterally between the leaf spring backbone and a first side of the fan blade spacer, and laterally between the leaf spring backbone and a second side of the fan blade spacer.

18. The fan assembly of claim 11, wherein the leaf spring backbone comprises at least one of a metallic material and a carbon composite material.

19. The fan assembly of claim 11, wherein the compliant member comprises at least one of an elastomeric material, a viscoelastic composite material and a plastically crushable material.

20. The fan assembly of claim 11, wherein the leaf spring backbone further comprises a second slot contact segment connected longitudinally between the second root contact segment and a third root contact segment, and wherein the compliant member is radially between the second spacer contact surface and the second slot contact segment, and radially between the first spacer contact surface and the third root contact segment.

* * * * *